US008302963B2

(12) United States Patent
Ban

(10) Patent No.: US 8,302,963 B2
(45) Date of Patent: Nov. 6, 2012

(54) IMAGE FORMING APPARATUS CAPABLE OF PRINTING ON BOTH SIDES OF SHEET

(75) Inventor: Naomichi Ban, Aichi (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 35 days.

(21) Appl. No.: 12/947,370

(22) Filed: Nov. 16, 2010

(65) Prior Publication Data

US 2011/0187039 A1 Aug. 4, 2011

(30) Foreign Application Priority Data

Jan. 29, 2010 (JP) ..... 2010-017677

(51) Int. Cl.
*B65H 7/02* (2006.01)

(52) U.S. Cl. ..... 271/258.02; 271/3.19; 271/279; 399/20; 399/401; 399/402

(58) Field of Classification Search ..... 271/3.19, 271/225, 258.01, 258.02, 279; 399/19, 20, 399/401, 402
See application file for complete search history.

(56) References Cited

U.S. PATENT DOCUMENTS

| | | | | |
|---|---|---|---|---|
| 4,130,354 | A * | 12/1978 | Steiner | 355/26 |
| 4,437,756 | A * | 3/1984 | Kawakubo et al. | 399/402 |
| 4,975,738 | A | 12/1990 | Senma et al. | |
| 5,103,267 | A * | 4/1992 | Wada et al. | 399/20 |
| 5,257,070 | A * | 10/1993 | Miller et al. | 399/20 |
| 6,085,049 | A * | 7/2000 | Tanigawa | 399/20 |
| 6,643,492 | B1 | 11/2003 | Kuga | |
| 2003/0063936 | A1 | 4/2003 | Sasaki et al. | |
| 2003/0067629 | A1 | 4/2003 | Sugishita | |
| 2004/0174552 | A1 | 9/2004 | Miyake et al. | |
| 2005/0084278 | A1 | 4/2005 | Kimura et al. | |
| 2006/0198676 | A1 | 9/2006 | Kimura et al. | |

FOREIGN PATENT DOCUMENTS

| | | |
|---|---|---|
| EP | 1311107 A2 | 5/2003 |
| EP | 1311107 A3 | 5/2004 |
| JP | HEI 02-196250 | 8/1990 |

(Continued)

OTHER PUBLICATIONS

Extended European Search Report dated Jan. 12, 2011.
Notification of Reasons for Rejection dated Dec. 6, 2011 received from the Japanese Patent Office from related Japanese Application No. 2010-017677, together with an English-language translation.

(Continued)

*Primary Examiner* — Jeremy R Severson
(74) *Attorney, Agent, or Firm* — Scully, Scott, Murphy & Presser, PC

(57) ABSTRACT

An image forming apparatus with a double-face printing function is provided. The image forming apparatus includes an image forming unit, a sheet feeding path including a regular feeding path and a return-feeding path and capable of accommodating a plurality of recording sheets, a sheet-ejection controller to eject the recording sheet out of the sheet feeding path through a sheet outlet. The sheet-ejection controller controls a recording sheet closer to the sheet outlet in the direction of sheet-conveyance along the sheet feeding path to be ejected prior to a recording sheet further from the sheet outlet when cancellation of the print job is entered during a double-face printing operation, in which the images are formed on one side of N pieces of recording sheets continuously and the other side of M pieces of recording sheets thereafter, whilst M is smaller than or equal to N.

9 Claims, 8 Drawing Sheets

FOREIGN PATENT DOCUMENTS

| | | | |
|---|---|---|---|
| JP | HEI 08-286586 | A | 11/1996 |
| JP | HEI 09-244322 | | 9/1997 |
| JP | 11-160919 | | 6/1999 |
| JP | 11-284818 | | 10/1999 |
| JP | 11-327216 | | 11/1999 |
| JP | 2002-14575 | | 1/2002 |
| JP | 2003-104612 | | 4/2003 |
| JP | 2004-34506 | A | 2/2004 |
| JP | 2005-305757 | A | 11/2005 |
| JP | 2008-203498 | A | 9/2008 |

OTHER PUBLICATIONS

Notification of Reasons for Rejection dated Jul. 17, 2011 received from the Japanese Patent Office from related Japanese Application No. 2010-017677, together with an English-language translation.

Notification of Reasons for Rejection dated Jul. 17, 2012 received from the Japanese Patent Office from related Japanese Application No. 2010-017677, together with an English-language translation.

* cited by examiner

IMAGE FORMING APPARATUS CAPABLE OF PRINTING ON BOTH SIDES OF SHEET

CROSS REFERENCE TO RELATED APPLICATION

This application claims priority from Japanese Patent Application No. 2010-017677, filed on Jan. 29, 2010, the entire subject matter of which is incorporated herein by reference.

BACKGROUND

1. Technical Field

An aspect of the present invention relates to an image forming apparatus which is capable of forming images on either side of a recording sheet.

2. Related Art

A printer which is capable of forming images on either side of a sheet of recording medium (e.g., paper) is known. When images are formed on both sides of the sheets (i.e., double-face printing), the printer may form images firstly on a same side of N sheets (N being a positive integer) continuously in a batch and thereafter on the other side of M sheets (M being a positive integer smaller than or equal to N). Thus, the double-face printing on both sides of the sheets can be completed in a shorter period of time than printing one side and the other side alternately. Such a shortened double-face printing operation, in which a plurality of sheets can reside in a sheet-feeding path at a same time, may be called quick double-face printing. For example, when images are formed on each side of 5 sheets of paper (i.e., 1-10 pages), the images may be formed on a second (even-numbered) page, a fourth (even-numbered) page, a first (odd-numbered) page, a sixth (even-numbered) page, a third (odd-numbered) page, an eighth (even-numbered) page, a fifth (odd-numbered) page, a tenth (even-numbered) page, a seventh (odd-numbered) page, and a ninth (odd-numbered) page in the order mentioned. For another example, images may be formed on first, third, fifth, second, seventh, fourth, ninth, sixth, eighth, and tenth pages in the order mentioned.

SUMMARY

In the above-mentioned printers, however, behaviors of the printer upon cancellation of a running print job during the quick double-face printing may not always be taken into consideration. Upon cancellation, for example, a plurality of sheets conveyed in the sheet-feeding path may be left unprocessed. When the unprocessed sheets are ejected out of the sheet-feeding path through a same process as the sheets are processed in the quick double-face printing operation, the sheets may be unnecessarily reversed in the sheet-feeding path, and ejection of all the unprocessed sheets may require longer time. Thus, the sheet-ejecting process can be improved in order to shorten the time for ejecting the unprocessed sheets.

In view of the above improvability, the present invention is advantageous in that an image forming apparatus, of which behaviors upon cancellation of a running print job during a quick double-face printing are improved, is provided.

According to an aspect of the present invention, an image forming apparatus, which is capable of printing images on two sides of a recording sheet according to a print job, is provided. The image forming apparatus includes an image forming unit to print an image on either side of the recording sheet, a sheet feeding path, in which the recording sheet is conveyed to have the image printed thereon, the sheet feeding path including a regular feeding path and a return-feeding path and capable of accommodating a plurality of recording sheets, a sheet-ejection controller to eject the recording sheet out of the sheet feeding path through a sheet outlet. The regular feeding path directs the recording sheet to pass by the image forming unit and to the sheet outlet. The return-feeding path is branched off from the regular feeding path at a branch point in a lower-stream position with respect to the image forming unit in a direction of sheet-conveyance and merged into the regular feeding path at a meeting point in an upper-stream position with respect to the image forming unit in the direction of sheet-conveyance. The sheet-ejection controller controls a recording sheet closer to the sheet outlet in the direction of sheet-conveyance along the sheet feeding path to be ejected prior to a recording sheet further from the sheet outlet in the direction of sheet-conveyance along the sheet feeding path when cancellation of the print job is entered during a double-face printing operation, in which the images are formed on one side of N pieces of recording sheets continuously and the other side of M pieces of recording sheets thereafter, whilst M is smaller than or equal to N.

BRIEF DESCRIPTION OF THE ACCOMPANYING DRAWINGS

DETAILED DESCRIPTION

Hereinafter, an embodiment of the present invention will be described with reference to the accompanying drawings. A printer 100 is an electrophotographic color printer capable of printing double-faces, in which images are formed on a same side of a plurality of sheets continuously and on the other side of the sheets later.

Overall Configuration of the Printer

Figure 1:
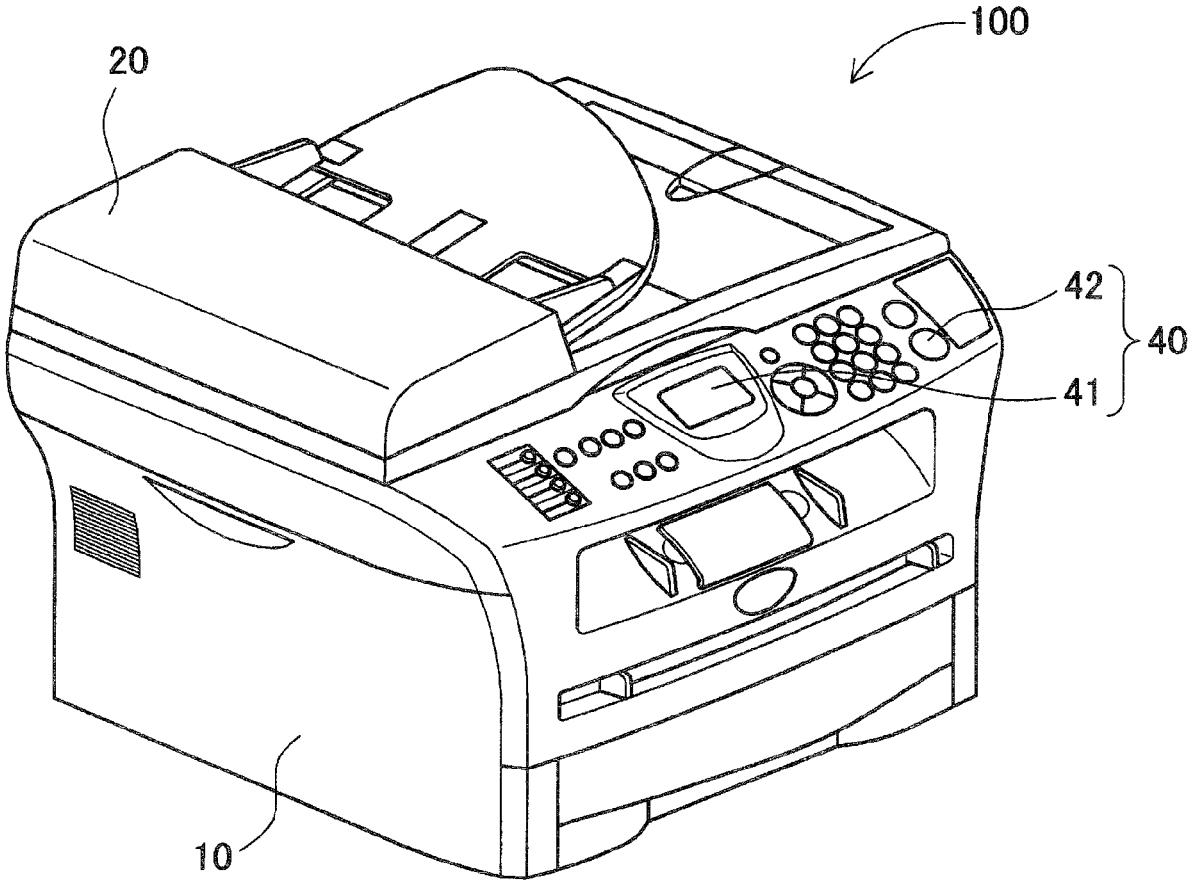
FIG. 1 is a perspective view of a printer according to an embodiment of the present invention.

The printer 100 (see FIG. 1) according to the present embodiment includes an image forming unit 10, which forms an image on a recording sheet, and an image reading unit 20, which reads an image formed on a sheet. The printer 100 has an operation panel 40, through which information concerning operations of the printer 100 is displayed and user's input is entered, on an upper front of the image reading unit 20. The operation panel 40 includes a display unit 41 being a liquid crystal display and buttons 42 including a start key, a stop key, and numerical keys (not shown).

Configuration of the Image Forming Unit in Detail

Figure 2:
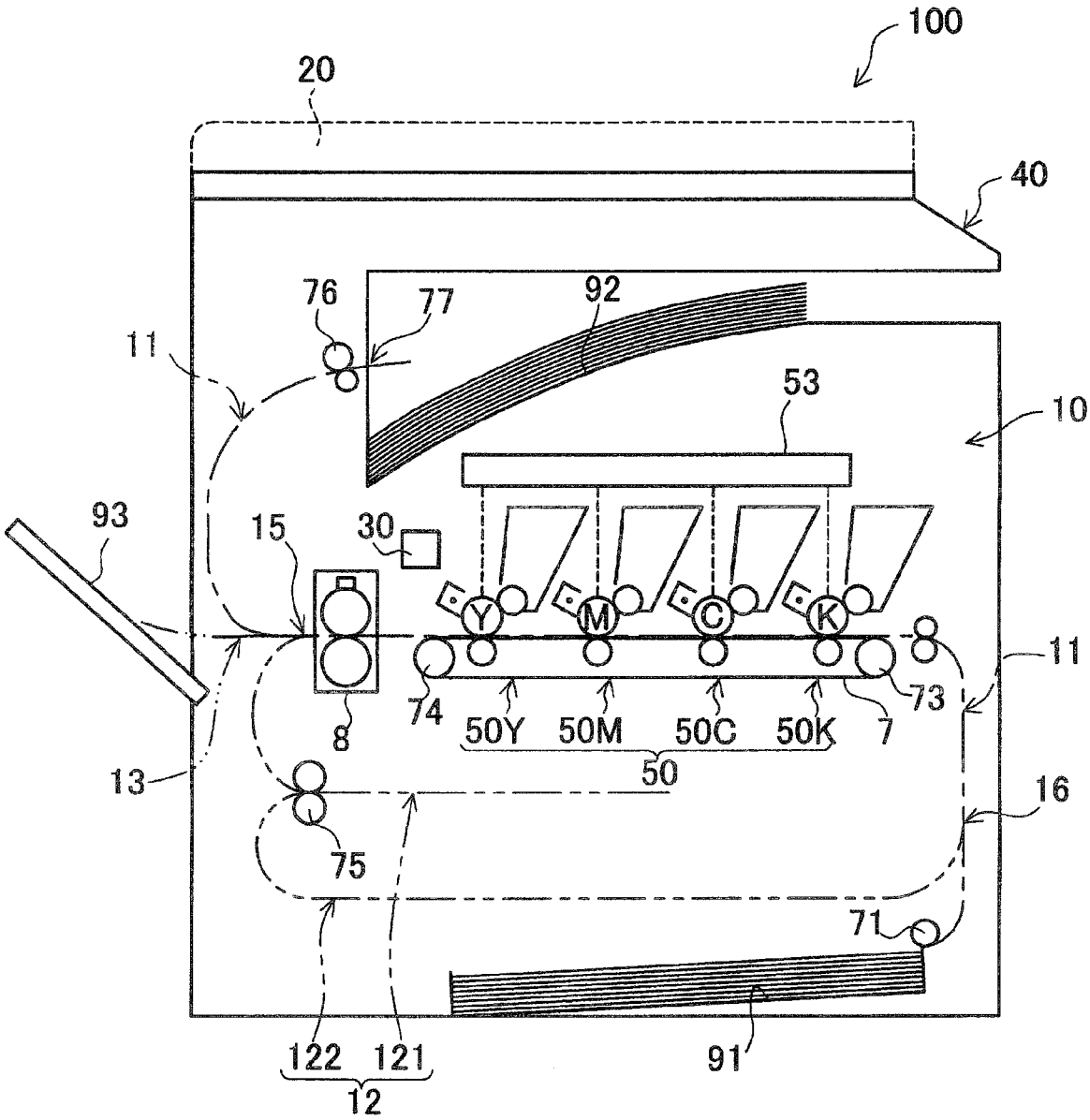
FIG. 2 is a schematic diagram to illustrate an internal configuration of the printer according to the embodiment of the present invention.

The image forming unit 10 (see FIG. 2) includes a processing unit 50, a fixing unit 8, and a sheet cassette 91, a discharge tray 92. The processing unit 50 develops toner images and transfers the toner images onto the sheet being conveyed. The fixing unit 8 fixes the toner transferred to the sheet thereto. The sheet cassette 91 is a container to store unused new sheets in a stack. The discharge tray 92 is a tray, in which ejected sheets with images printed thereon are settled. Further, the image forming unit 10 includes a regular feeding path 11, in which the sheet picked up from the sheet cassette 91 by a feed roller 71 is conveyed to pass through the processing unit 50, the fixing unit 8, discharge rollers 76, and a sheet outlet 77. The sheet conveyed through the sheet outlet 77 is ejected and directed in the discharge tray 92. In FIG. 2, the regular feeding path 11 is indicated by a dotted line and winded in a form of an S.

The processing unit 50 includes four (4) processors 50Y, 50M, 50C, 50K aligned in line, which enable image forming in colors. In particular, the processor 50Y forms an image in yellow, the processor 50M forms an image in magenta, the processor 50C forms an image in cyan, and the processor 50K forms an image in black. The processing unit 50 further includes an exposure unit 53, which emits beams to the processors 50Y, 50M, 50C, 50K, and a conveyer belt 7, which is extended to roll around rollers 73, 74 to convey the sheet to pass by the processors 50Y, 50M, 50C, 50K. The processors 50Y, 50M, 50C, 50K are developer devices to develop toner images in a known electrophotographic method.

The image forming unit 10 picks up the sheets stored in the sheet cassette 91 one by one to convey and feed the processor unit 50 with the sheet. The processor unit 50 fed with the sheet transfers the toner image developed in the processors 50Y, 50M, 50C, 50K to a surface of the sheet, and the sheet with the transferred image is forwarded to the fixing unit 8, in which the toner on the sheet is thermally fixed thereto. The sheet with the fixed image is conveyed further and ejected to be placed in the discharge tray 92.

In the image forming unit 10, a double-face printing, in which images are formed on either side of the sheet, is available. In a double-face printing operation, the sheet with an image formed on one side is reversed to be conveyed in a return-feeding path 12 (see FIG. 2) to have another image formed on the other side thereof by the same processing unit 50. The return-feeding path 12 is indicated by double-dotted lines in FIG. 2. The return-feeding path 12 is branched off from the regular feeding path 11 at a branch point 15, which is at a lower-stream position with respect to the fixing unit 8 in a direction of sheet-conveyance. Further, the return-feeding path 12 is merged into the regular feeding path 11 at a meeting point 16, which is at an upper-stream position with respect to the processing unit 50. In the present embodiment, the one side of the sheet, on which the image is formed firstly, is referred to a "side A," and the other side, on which another image is formed secondly, is referred to as a "side B." Further, the side A is a verso page, which is to be viewed by a reader secondly after the side B, and the side B is a recto page, which is to be viewed firstly prior to the side A when the images are completed on both sides A, B of the sheet.

The return-feeding path 12 includes a pull-in path 121, in which the sheet is temporally pulled in to be reversed, and a returning path 122, which directs the reversed sheet to return to the regular feeding path 11 again.

Sheet-reversing behaviors in the image forming unit 10 during double-face printing will be described hereinbelow. The sheet picked up from the sheet cassette 91 is conveyed in the regular feeding path 11 to have the image formed on the side A and carried through the fixing unit 8 to have the image fixed thereon. The sheet is directed in the pull-in path 121 with the aid of a turning roller 75 and stopped to pause thereat. Thereafter, rotation of the turning roller 75 is switched to rotate in an opposite direction in order to switch the direction of conveying the sheet. Accordingly, the sheet is directed in the returning path 122 and returns in the regular feeding path 11 at the meeting point 16. Thus, the sheet is reversed in the regular feeding path 11 with the side B up facing the processing unit 50. However, the sheet may not necessarily be reversed in the above-described mechanism, but may be reversed in a different mechanism as long as double-face printing is achieved.

Figure 3:
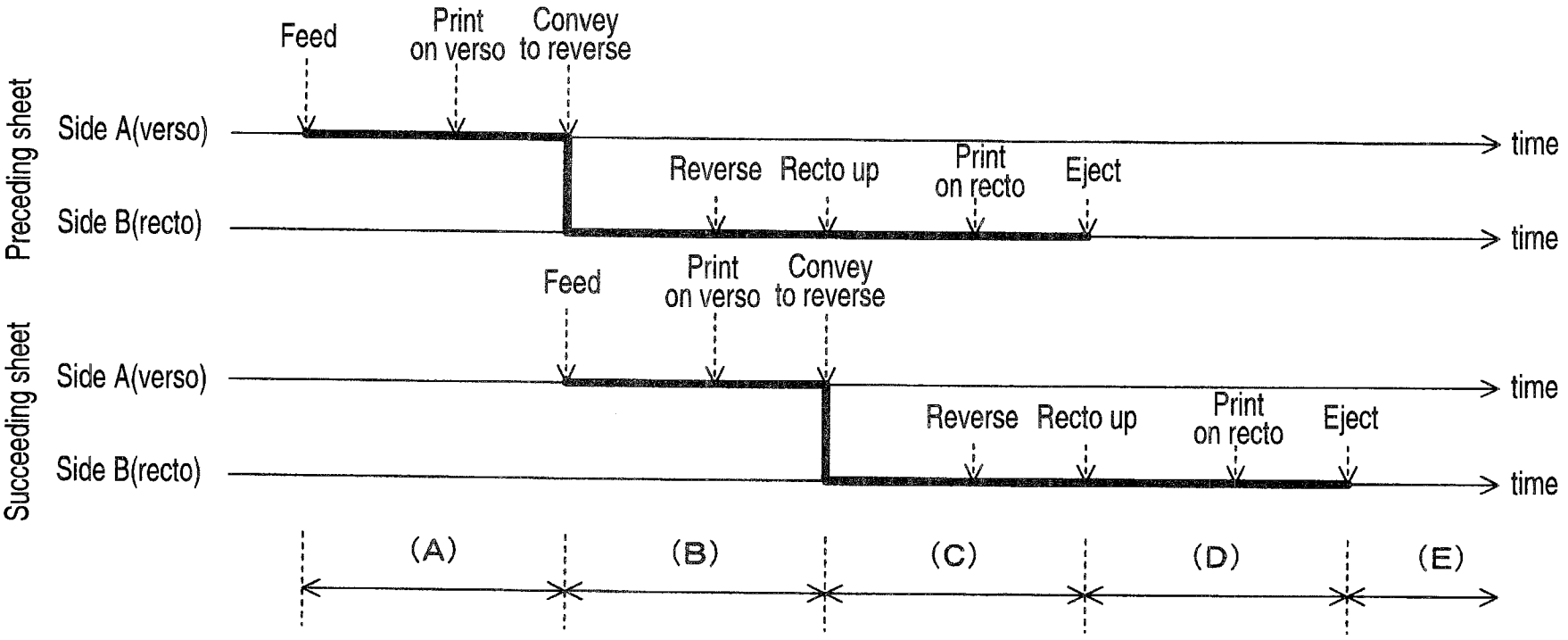
FIG. 3 illustrates timelines and sheet-processing behaviors in a quick double-face printing cycle in the printer according to the embodiment of the present invention.

According to the present embodiment, upon quick double-face printing, the image forming apparatus 10 is capable of printing on the side As of N sheets (N being a positive integer) continuously, and thereafter, printing images on the side Bs of M sheets (M being a positive integer smaller than or equal to N) in a quick double-face printing cycle. FIG. 3 illustrates timelines and sheet-processing behaviors in a quick double-face printing cycle in the image forming unit 10 when, for example, N is 2 (N=2) and M is 2 (N=M).

In the quick double-face printing cycle, two (2) sheets, which include a preceding sheet S1 and a succeeding sheet S2, can be serially conveyed in the regular and return feeding paths 11, 12. The preceding sheet S1 and the succeeding sheet S2 are fed and conveyed in the image forming unit 10 according to the timelines, which are divided into five phases: A, B, C, D, and E. In phase A, the preceding sheet S1 is fed into the regular feeding path 11, and an image is formed on the side A of the preceding sheet S1. In phase B, the preceding sheet S1 is conveyed to the return-feeding path 12 to be reversed (side B up). Meanwhile, the succeeding sheet S2 is fed into the regular feeding path 11, and an image is formed on the side A of the succeeding sheet S2. In phase C, the succeeding sheet S2 is conveyed to the return-feeding path 12 to be reversed (side B up). Meanwhile, the preceding sheet S1 is conveyed to return in the regular feeding path 11, and an image is formed on the side B of the preceding sheet S1. In phase D, the preceding sheet S1 is ejected. Meanwhile, the succeeding sheet S2 is conveyed to return in the regular feeding path 11, and an image is formed on the side B of the succeeding sheet S2. In phase E, the succeeding sheet S2 is ejected.

In phase E, when a third sheet S3 follows after the succeeding sheet S2, the third sheet S3 becomes a new succeeding sheet, and the succeeding sheet S2 now becomes a preceding sheet in the next quick double-face printing cycle, in which the phases A-E are repeated.

Thus, in the image forming unit 10, the images are formed on the side A of the preceding sheet S1, the side A of the succeeding sheet S2, the side B of the preceding sheet S1, and the side B of the succeeding sheet S2, in the order described. According to this order, idling time for the processing unit 50, in which the processing unit 50 is kept inactive, is shortened compared to idling time for a processing unit which prints images on each side of a preceding sheet continuously prior to start printing images on a succeeding sheet. Therefore, total running time for the print job is efficiently shortened.

A maximum allowable number for the number N of sheets to be continuously printed in a single quick double-face printing cycle depends on a quantity of sheets to be accommodated in the return-feeding path 12. The quantity of sheets to be accommodated in the return-feeding path 12 is determined based on, for example a length of the return-feeding path 12 and a length of the sheets. Therefore, the number N of sheets to be collectively printed in a single quick double-face printing cycle is not limited to two but may be three or more.

According to the present embodiment, a length of the returning path 122 in the return-feeding path 12 is greater than a length between the feed roller 71 and the meeting point 16 in the regular feeding path 11. Accordingly, in phase B, distance between a front edge of the preceding sheet S1 and the branch point 15 is greater than distance between a front edge of the succeeding sheet S2 and the branch point 15. When the length between the feed roller 71 and the meeting point 16 is greater than the length of the returning path 122, the preceding sheet S1 may be controlled to pause in the return-feeding path 12 to adjust timing in order to allow a rear edge of the succeeding sheet S2 passes the meeting point before the front edge of the preceding sheet S1 reaches the meeting point 16.

The image forming unit 10 is provided with a discharge tray 93, which can be pivoted to open and close with respect to a side surface of the printer 100. When the discharge tray 93 is in an open position (see FIG. 2), a sheet with an image printed thereon can be led to the discharge tray 93. Further, the image forming unit 10 is provided with a linear path 13, which directs the sheet with the image fixed thereon from the regular feeding path 11 to the discharge tray 93. The linear path 13, as indicated by a triple-dotted line in FIG. 2, is branched off from the regular feeding path 11 at a lower-stream point with respect to the branch point 15 of the return-feeding path 12.

Electrical Configuration of the Printer

Figure 4:
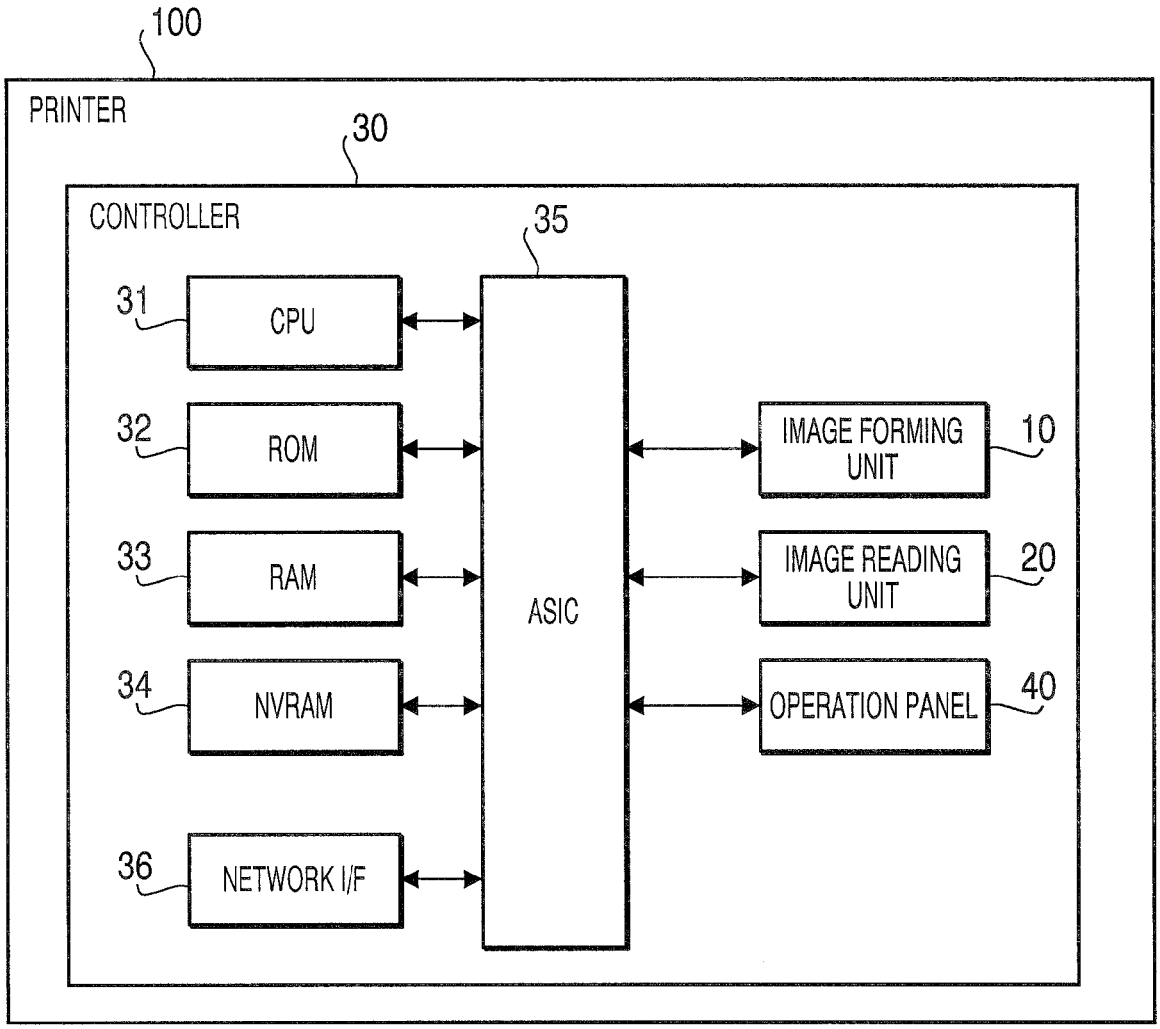
FIG. 4 is a block diagram to illustrate an electrical configuration of the printer according to the embodiment of the present invention.

The electrical configuration of the printer 100 will be described (see FIG. 4). The printer 100 is provided with a controller unit 30, which includes a CPU 31, a ROM 32, a RAM 33, a non-volatile RAM (NVRAM) 34, an ASIC 35, and a network interface (UF) 36. The controller unit 30 is electrically connected with the image forming unit 10, the image reading unit 20, and the operation panel 40.

The ROM 32 stores programs to control the printer 100 and information concerning operation settings and initial settings of the printer 100. The RAM 33 serves as a work area, in which the controlling programs are developed, and a memory area, in which image data is temporarily stored.

The CPU 31 controls behaviors of the printer 100 through the ASIC 35. In particular, the CPU 31 processes information from the controlling programs and signals obtained from various sensors (not shown) and stores the information in the RAM 33 and the NVRAM 34 to drive components in the printer 100. The CPU 31 controls, for example, timing for emitting light from the exposure unit 53, activation of a driving motor (not shown) to drive the rollers in the regular feeding paths 11 and the return-feeding path 12, and a driving motor (not shown) to move an image sensor unit (not shown) in the image reading unit 20.

Cancellation of Quick Double-Face Printing

Behaviors of the printer 100 upon cancellation of the quick double-face printing will be described. The printer 100 aborts a running print job when the stop key in the operation panel 40 is pressed by a user. More specifically, the printer 100 receives a request for cancellation from the user, stops printing behaviors, and ejects the sheets remaining in the regular feeding path 11 and the return-feeding path 12.

In particular, if the printer 100 is in the quick double-printing cycle when the cancellation request is entered, the printer 100 determines an order to eject the remaining sheets. For example, when the cancellation request is entered in either phase B or C in the quick double-face printing cycle shown in FIG. 3, two sheets S1, S2 remain in the feeding paths 11, 12. Therefore, the printer 100 determines which sheet between the preceding sheet S1 and the succeeding sheet S2 is to be ejected firstly based on positions of the sheets S1, S2 and urgency required by the user.

Sheet-Processing Flow

Figure 5:
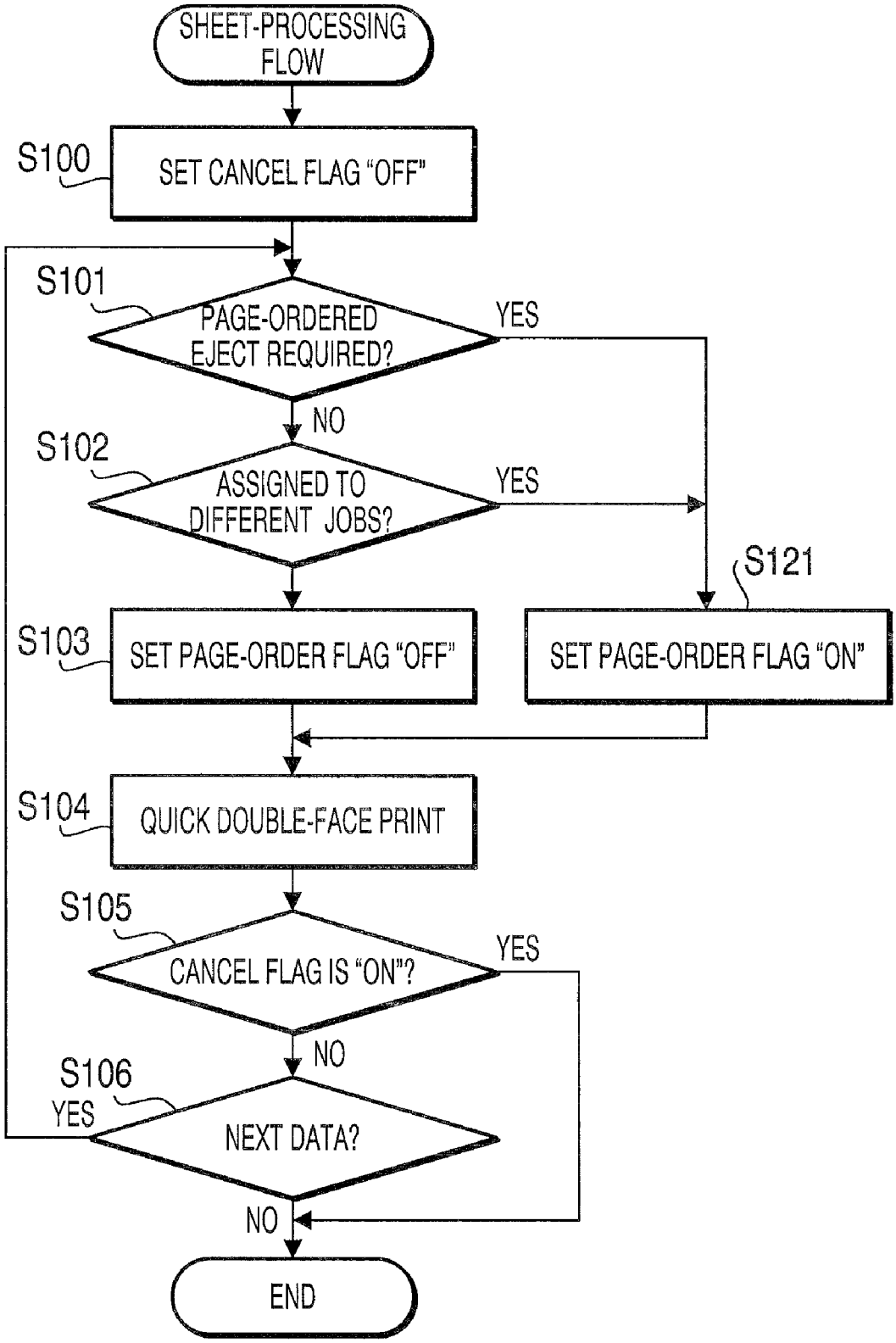
FIG. 5 is a flowchart to illustrate a sheet-processing flow of the printer according to the embodiment of the present invention.

A flow to process sheets in the quick double-face printing cycle will be described with reference to FIG. 5. The sheet-processing flow is activated when a print job for printing images on both sides of a sheet is entered.

When the flow starts, in S100, the printer 100 sets a cancel flag "OFF." The cancel flag is set in a predetermined memory area (not shown), for example, in the RAM 33. Following S100, in S101, the printer 100 judges as to whether the print job requires the sheets be ejected in an order of page numbers. A print job which requires page-ordered eject of sheets may be, for example, sort-printing, in which print outputs are stacked in the order of page numbers. If the print job does not require page-ordered eject (S101: NO), in S102, the printer 100 judges as to whether the sheets being accommodated in the feeding paths 11, 12 are assigned to two different print jobs. In other words, it is judged as to whether the sheets remaining in the feeding paths 11, 12 include a sheet for a last page in a preceding print job and a sheet for a first page in a succeeding print job. If the sheets are not for two different print jobs (S102: NO), in S103, a page-order flag is set "OFF." In S101, if the print job requires page-ordered eject (S101: YES), or in S102, if the sheets are assigned to two different jobs (S102: YES), in S121, the page-order flag is set "ON." In the sheet-processing flow, the order of the steps S101 and S102 can be reversed.

Following S103 or S121, in S104, the printer 1 conducts a quick double-face printing cycle for two sheets including four pages. In particular, images are printed on the side A (i.e., page 2) of the preceding sheet S1, the side A (i.e., page 1) of the succeeding sheet S2, the side B (i.e., page 4) of the sheet S1, and the side B (i.e., page 3) of the succeeding sheet S2, in the order described.

In S105, the printer 100 judges as to whether a cancellation request was entered during the quick double-face printing cycle. In particular, the printer 100 examines as to whether the cancel flag has been set "ON" during the quick double-face printing cycle in S104. When the cancel flag is "ON," the printer 100 judges that the cancellation request was entered (see also S153 in FIGS. 6 and 7). If the cancellation request was entered (S105: YES), the printer 100 terminates the sheet-processing flow. If no cancellation request was entered during the quick double-face printing cycle, that is, if the cancel flag has been "OFF" (S105: NO), in S106, the printer 100 judges as to whether next print data for a new page is inputted. If next data is inputted (S106: YES), the flow returns to S101 and repeats the sheet-processing flow. If no next print data is inputted (S106: NO), the printer 100 terminates the flow.

Cancelling Flow (First Example)

Figure 6:
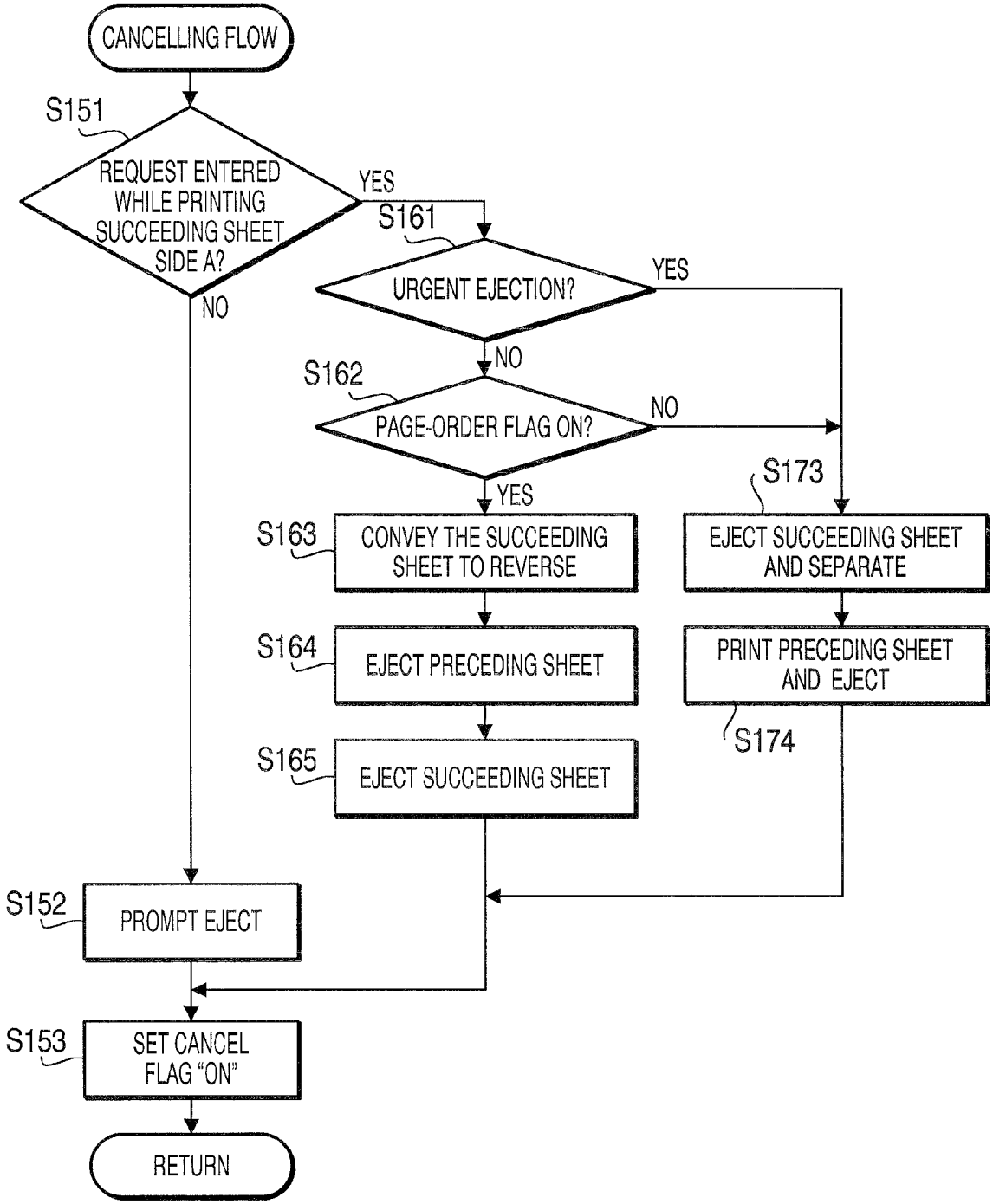
FIG. 6 is a first example of a flowchart to illustrate a canceling flow of the printer according to the embodiment of the present invention.

A first example of a canceling flow, which is activated when the cancellation request was entered during the sheet processing flow (see FIG. 5), will be described with reference to FIG. 6.

In S151, the printer 100 judges as to whether the cancellation request was entered within a period, in which the image is being formed on the side A of the succeeding sheet S2 (i.e., phase B shown in FIG. 3). In particular, the period of phase B starts when a front end of the succeeding sheet S1 passes the branch point 15. Phase B period continues whilst the succeeding sheet S1 is conveyed in the return-feeding path 12 and being reversed. Further, in phase B, an image is printed on the side A of the succeeding sheet S2. Phase B period ends when a front end of the succeeding sheet S2 passes the branch point 15 to be conveyed into the return-feeding path 12.

If the cancellation request was entered during a time period other than the phase B period (S151: NO), in S152, the printer 100 ejects the sheets S1, S2 in a prompt fashion, in which the sheet closer to the sheet outlet 77 along the feeding paths 11, 12 is ejected earlier than the other sheet further from the sheet outlet 77. Thus, in S152, the sheets S1, S2 are promptly ejected without being conveyed into the return-feeding path 12 regardless of situation of image printing on the side Bs. Accordingly, the remaining sheets S1, S2 are ejected in shorter time. Following S152, in S153, the printer 100 sets the cancel flag "ON" and returns to the sheet-processing flow (see FIG. 5).

For example, if the cancellation request was entered in phase C shown in FIG. 3 (S151: NO), the preceding sheet S1 remains in the regular feeding path 11, and the succeeding sheet S2 remains in the return-feeding path 12. Therefore, the preceding sheet S1, which is closer to the sheet outlet 77 along the feeding paths 11, 12, is ejected firstly, and the sheet S2 is ejected thereafter. In this regard, the sheets S1, S2 are eject in the same order as an initial order, in which the sheets S1, S2 would otherwise be ejected after completion of image forming on both sides. For another example, if the cancellation request was entered in phase A or in phase D, the feeding paths 11, 12 accommodate solely one sheet (either sheet S1 or S2). In this regard, an order to eject the sheet is not concerned. Therefore, the remaining sheet is ejected without being conveyed into the return-feeding path 12.

If the cancellation request was entered in phase B, in which the image is formed on the side A of the succeeding sheet S2 (S151: YES), the sheets S1, S2 remain in the return-feeding path 12 and the regular feeding path 11 respectively. Therefore, the sheet S2 in the regular feeding path 11, remaining in a position closer to the sheet outlet 77 along the feeding paths 11, 12, is firstly ejected, and thereafter, the sheet S1 in the return-feeding path 12 is ejected. In this regard, the sheets S1, S2 are ejected in a reverse order opposite from the initial order.

In order to eject the sheets S1, S2 in one of the above-described orders (the initial order or the reverse order), the printer 100 performs the following steps. That is, after the affirmative judgment in S151 (S151: YES), in S161, the printer 100 judges as to whether the cancellation request requires urgent ejection. According to the present embodiment, if the stop key is pressed twice or more in a predetermined time period, the printer 100 determines that the cancellation request requires urgent ejection. Alternatively, the printer 100 may determine the cancellation request requires urgent ejection if the stop key is held pressed for a predetermined time period or if the printer 100 has a large number of print jobs on hold. Alternatively, the printer 100 may be provided with a specific stop key to be pressed to enter the cancellation request requiring urgent rejection. Alternatively, a direct cancellation request, entered through the operation panel 40 of the printer 100, may be judged to be the request requiring urgent ejection whilst a remote cancellation request, entered through a personal computer connected with the printer 100, may be judged to be a cancellation request requiring ejection with low urgency. In the last example of judgment, it may be considered that sheet ejection based on the direct cancellation request entered by a user who is in the vicinity of the printer 100 is handled urgently and sheet ejection based on the remote cancellation request entered by a remote user who is further from the printer 100 is handled less urgently, since the remote user takes time to walk to the printer 100 anyway.

In S161, if the cancellation request requires urgent ejection (S161: YES), in S173, the printer 100 ejects the succeeding sheet S2 in a discharge tray separately from the sheet S1. Thereafter, in S174, the printer 100 prints an image on the side B of the preceding sheet S1 and ejects the preceding sheet S1 separately from the succeeding sheet S2. In S173-S174, in order to complete ejecting the sheets S1, S2 in shorter time, the printer 100 ejects the succeeding sheet S2 being closer to the discharge outlet 77 firstly and the preceding sheet S1 being further from the discharge outlet 77 thereafter (i.e., the reverse order). In the reverse order, the sheets S1, S2 are ejected in the opposite order from the initial order, in which the sheets S1, S2 would have been ejected after completion of image forming on both sides. Therefore, the printer 100 ejects the preceding sheet S1 in the discharge tray 92 and the succeeding sheet S2 in the discharge 93 separately from the preceding sheet S1. Thus, the preceding sheet S1, which has images printed completely on both sides A, B, and the succeeding sheet S2, which has an image printed solely on one side A, can be recognized easily by the user.

In S161, if the cancellation request does not specifically require urgency in ejection of the sheets (S161: NO), in S162, the printer 100 judges as to whether the page-order flag is on. If the page-order flag is off (S162: NO), the flow proceeds to S173, in which the printer 100 ejects the succeeding sheet S2 in the discharge tray 93 separately from the sheet S1. Further in S174, the printer 100 prints an image on the side B of the preceding sheet S1 and ejects the preceding sheet S1 in the discharge tray 92. Thus, whilst the page-ordered ejection is not required, the sheets S1, S2 can be ejected in shorter time.

In S162, if the page-order flag is on (S162: YES), the sheets S1, S2 are required to be ejected according to the order of the page number. Therefore, in S163, the succeeding sheet S2 remaining in the regular feeding path 11 is conveyed into the return-feeding path 12. In S164, the printer 100 conveys the preceding sheet S1 in the regular feeding path 11 and prints an image on the side B of the preceding sheet S1. The preceding sheet S1 is ejected thereafter. In S165, the printer 100 conveys the succeeding sheet S2 to return in the regular-feeding path 11 and ejects the succeeding sheet S2 without printing an image on the side B. Thus, the preceding sheet S1 is ejected firstly, and the succeeding sheet S2 is ejected thereafter in the initial order although the succeeding sheet S2 is closer to the discharge outlet 77 with respect to the preceding sheet S1. In other words, positional relation of the sheets S1, S2, in terms of closeness to the discharge outlet 77, in the feeding paths 11, 12 is not considered. Following S165, in S153, the printer 100 sets the cancel flag "ON" and returns to the sheet-processing flow (see FIG. 5).

In the above-described cancelling flow, the printer 100 ejects the remaining sheets S1, S2 through a process, which is one of the prompt ejection in S152, separate ejection in shorter time in S173-S174, and the page-ordered ejection in S163-S165, depending on the print conditions, positions of the remaining sheets, and the urgency of ejection. After completion of ejecting the remaining sheets S1, S2, the printer 100 terminates the cancelling flow.

Optionally, in S165 and S173, the printer 100 may print an image on the side B of the succeeding sheet S2 prior to ejecting according to the print condition. For example, if the cancellation request is entered during or after a printing operation of an image on the side A of the succeeding sheet S2, the succeeding sheet S2 may have an image printed on the side B to have the images completed on both sides.

Cancelling Flow (Second Example)

Figure 7:
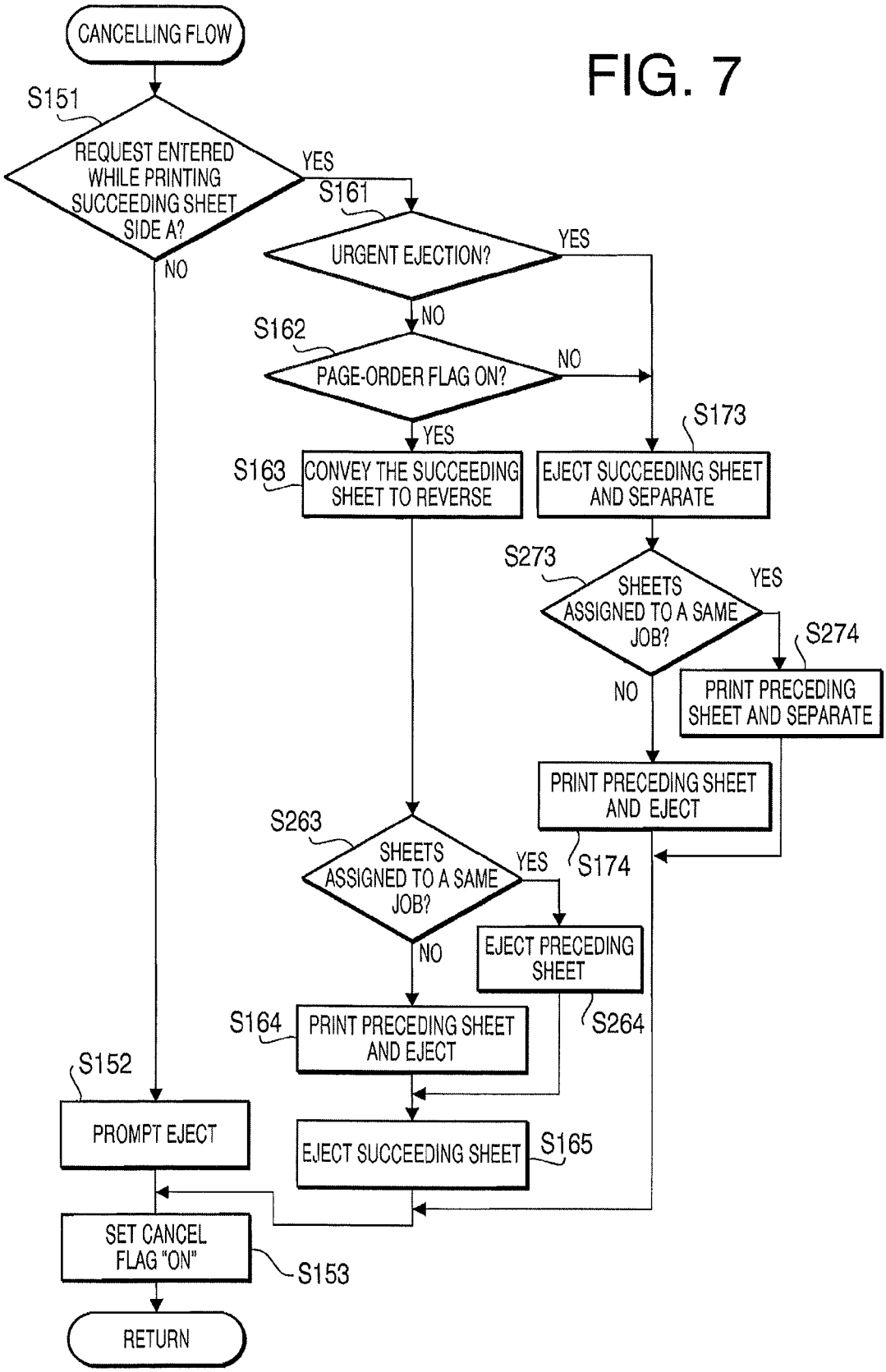
FIG. 7 is a second example of a flowchart to illustrate the canceling flow of the printer.

A second example of the canceling flow will be described with reference to FIG. 7. In the second example, the cancelling flow includes a smaller number of image-printing steps than the cancelling flow in the first example so that unnecessary printing operations can be omitted after entry of the cancellation request. The cancelling flow in the second example differs from the first example in behaviors of the printer 100 when the cancellation request is entered during the phase B period, in which the image is being formed on the side A of the succeeding sheet S2 (S151: YES). The remaining behaviors of the printer 100 in the cancelling flow in the second example are equivalent to the first example. Therefore, the equivalent behaviors are referred to as the same reference step numbers, and description of those will be omitted.

Following the affirmative judgment in S151 (S151: YES), and if the cancellation request requires urgent ejection of the sheets (S161: YES), or if the cancellation request does not require urgency in ejecting the sheets (S161: NO), but the page-order flag is on (S162: YES), the flow proceeds to S173. In S173, the printer 100 ejects the succeeding sheet S2 in the discharge tray 93 separately from the sheet S1. Thereafter, in S273, the printer 100 judges as to whether the sheets S1, S2 remaining in the feeding paths 11, 12 are assigned to a same print job.

If the sheets S1, S2 are assigned to a same print job (S273: YES), in S274, the printer 100 ejects the preceding sheet S1 separately from the succeeding sheet S2 without printing an image on the side B. Following S274, in S153, the printer 100 sets the cancel flag "ON" and returns to the sheet-processing flow (see FIG. 5). According to the present embodiment, when a print job is cancelled, and if the remaining sheets S1, S2 are assigned to the same print job, the print output as a whole, including the sheets S1, S2, is incomplete at any rate even with the preceding sheet S1 having complete images printed on both sides A, B. When the printed output is incomplete, the print output including the sheet S1 with the images on both sides is likely to be discarded, and toner used for printing the images on the sheets may be wasted. In order to avoid such waste of toner, therefore, when the remaining sheets S1, S2 are assigned to the same print job, the printer 100 ejects the sheet S1 separately from the sheet S2 without printing an image on the side B of the sheet 1.

If the sheets S1, S2 are assigned to different print jobs (S273: NO), in S174, the printer 100 prints the image on the side B of the preceding sheet S1 and ejects the preceding sheet S1. When the sheets S1, S2 are assigned to different print jobs, the sheet S1 is a last sheet in the preceding print job, and printing an image on the side B of the preceding sheet S1 completes the preceding print job. The completed print output can be provided to the user to be used. Therefore, in S174, the printer 100 prints the image on the side B of the preceding sheet S1 to complete at least the preceding print job and ejects the preceding sheet S1. Following S174, in S153, the printer 100 sets the cancel flag "ON" and returns to the sheet-processing flow (see FIG. 5).

In S161, if the cancellation request does not specifically require urgency in ejection of the sheets (S161: NO), and if the page-order flag is on (S162: YES), in S163, the succeeding sheet S2 remaining in the regular feeding path 11 is conveyed into the return-feeding path 12. Thereafter, in S263, the printer 100 judges as to whether the sheets S1, S2 remaining in the feeding paths 11, 12 are assigned to a same print job.

If the sheets S1, S2 are assigned to a same print job (S263: YES), in S264, the printer 100 conveys the preceding sheet S1 in the regular feeding path 11 and ejects the preceding sheet S1 without printing an image on the side B of the preceding sheet S1. If the sheets S1, S2 are assigned to different print jobs (S263: NO), in S164, the printer 100 conveys the preceding sheet S1 in the regular feeding path 11 and prints an image on the side B of the preceding sheet S1. The preceding sheet S1 is ejected thereafter. In S165, printer 100 conveys the succeeding sheet S2 to return in the regular-feeding path 11 and ejects the succeeding sheet S2 without printing an image on the side B.

According to the second example, the printer 100 prints the image on the side B of the preceding sheet S1 if the sheets S1, S2 assigned to two different print jobs remain in the feeding paths 11, 12 when the cancellation request was entered. In other words, if the remaining sheets S1, S2 are assigned to a same print job, the printer 100 does not print the image on the side B of the preceding sheet S1. Therefore, printing an image on the sheet to be discarded can be omitted, and waste of toner can be prevented. Whilst, in the first example, the image is printed on the side B of the preceding sheet S1 regardless of unity of the print job, in the second example, the ejected sheets include less incomplete printed output in the cancelling flow. Thus, the printed output can be effectively used.

As has been described above, the printer 100 according to the present embodiment completes ejecting the sheets remaining in the regular feeding path 11 and the return-feeding path 12 in response to the cancellation request. In this regard, the sheet in a position closer to the sheet outlet 77 is ejected prior to the sheet in a position further from the sheet outlet 77. Therefore, ejection of the sheets can be completed efficiently in shorter time, and the printer 100 can provide improved usability to the user. The quick ejection of sheets can release the user and the printer 100 itself from being detained on the cancelled print job.

In the above embodiment, the printer 100 can eject the sheet through the return-feeding path 12 when the page-order flag is on. Accordingly, the sheet remaining in the return-feeding path 12 (i.e., the preceding sheet S1) when the cancellation request is entered can be ejected prior to the sheet remaining in the regular feeding path 11 (i.e., the succeeding sheet S2). In particular, in the above examples, the preceding sheet S1 is ejected through the return-feeding path 12 when the print job requires sorted ejection or when the remaining sheets are for two different jobs. Thus, the ejected sheets are stacked in the order of page numbers, and the printer 100 can provide improved usability to the user.

According to the above configuration of the printer 100, when the print job is cancelled during the double-face printing cycle and the recording sheets are halted in the sheet feeding paths 11, 12, the recording sheet closer to the discharge outlet 77 along the sheet feeding paths 11, 12 is ejected earlier. Therefore, ejection the sheets remaining in the sheet feeding paths 11, 12 completes efficiently in shorter time, and the printer 100 can release the user and the printer 100 itself from being detained on the cancelled print job.

According to the above configuration of the printer 100, the printer 100 ejects the recording sheets in the sheet feeding paths 11, 12 in the order of page numbers by conveying a part of the recording sheets through the return-feeding path 12 regardless of positional relation of the recording sheets in the sheet feeding path 11, 12. Therefore, the recording sheet remaining in the return-feeding path 12 at the time of entry of the cancellation request can be ejected earlier. If the recording sheets are ejected according to the closeness from the discharge outlet 77 even when page-ordered ejection is required, the ejected print output may be stacked in a wrong order, and the user may need to sort the print output manually in the initially intended order. Therefore, when the page-ordered ejection is required, the printer 100 ejects the recording sheet regardless of positional relation of the recording sheets so that the ejected recording sheets are stacked in the order of page numbers. Thus, the order of ejecting the remaining recording sheets can be switched according to the user's preference.

According to the above configuration of the printer 100, when the recording sheets accommodated in the sheet feeding paths 11, 12 are assigned to different print jobs including a preceding print job and a succeeding print job, the printer 100 ejects the recording sheets on basis of the print job by conveying a part of the recording sheets through the return-feeding path 12. Therefore, the recording sheet assigned to the succeeding print job in the regular feeding path 11 can be conveyed through the return-feeding path 12 prior to being ejected so that the recording sheet assigned to the preceding print job in the regular feeding path 11 can be ejected earlier. Thus, the ejected recording sheets can be stacked on different batches on basis of the print job, and the user can easily recognize the batch representing the desired print job.

According to the above configuration of the printer 100, the recording sheet in the sheet feeding paths 11, 12 closer to the discharge outlet 77 is ejected prior to the recording sheet further from the discharge outlet 77 when affirmative judgment is made in S161. Meanwhile, the printer 100 ejects the recording sheets in the sheet feeding paths 11, 12 in the order of page numbers by conveying a part of the recording sheets through the return-feeding path 12 when negative judgment is made in S161. Therefore, whilst the page-ordered ejection may take longer time, the order of ejecting the recording sheets can be efficiently switched based on the urgency.

According to the above configuration of the printer 100, the image is printed on the side B of the recording sheet which is conveyed through the return-feeding path 12 after the entry of the cancellation request. Therefore, the recording sheet ejected through the return-feeding path 12 has images formed on both sides. Thus, the recording sheet ejected through the return-feeding path 12 has the complete images on both sides, and producing an incomplete print output can be omitted.

According to the above configuration of the printer 100, the printer 100 prints the image on the side B of the recording sheet assigned to the preceding job when the recording sheets accommodated in the sheet feeding paths 11, 12 are assigned to different jobs. Therefore, the recording sheet assigned to the preceding job has complete images on both sides, and at least the preceding job can be completed. Meanwhile, even though the succeeding print job may be cancelled incomplete, waste of toner for the cancelled print job can be efficiently omitted.

According to the above configuration of the printer 100, the recording sheet with the image printed on the side B is ejected separately from the recording sheet with no image printed on the side B. Therefore, the recording sheet with the complete images on both sides A, B and the recording sheet with the incomplete images can be easily recognized by the user.

According to the above configuration of the printer 100, the side A of the recording sheet is an even-numbered page, and the side B of the recording sheet is an odd-numbered page. According to the page printing order, the images can be printed on the continuously-fed recording sheets efficiently.

Although examples of carrying out the invention have been described, those skilled in the art will appreciate that there are numerous variations and permutations of the printer that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the present invention can be similarly effectively applied to other image forming apparatuses having a quick double-face printing function such as a multifunction peripheral device and a facsimile machine. Further, the image forming unit in the image forming apparatus may not necessarily form images electro-photographically, but may form in, for example, inkjets. Furthermore, the image forming apparatus may be either a multi-color image forming apparatus or a monochrome image forming apparatus.

In the embodiment of the present invention, the printer 100 prints images on the side As of a plurality of sheets continuously and on the side Bs of the plurality of sheets thereafter in a single quick double-face printing cycle. However, the printer may print images on the side As of a plurality of sheets continuously, and print images on the side B and the side A alternately. More specifically, for example, when the number N of the side As to be continuously printed in a single quick double-face printing cycle is initially 2 at the activation of the quick double-face printing, and thereafter the number N and the number M of the side Bs to be continuously printed are switched to both 1, images are formed on the side As of the first and second sheets S1, S2 initially. Thereafter, an image is formed on the side B of the first sheet S1, and the first sheet S1 is ejected in the discharge tray 92. Further, a third sheet S3 is conveyed in the regular feeding path 11 to have an image formed on the side A (phase A). In this regard, the second sheet S2 is maintained in the return-feeding path 12 and not conveyed to return in the regular feeding path 11. Following phase A, the sheet S3 is conveyed in the return-feeding path 12, and the second sheet S2 is conveyed to return in the regular feeding path 11 to have an image printed on the side B (phase B). Thereafter, the phases A and B are repeated alternately. When, for example, images are printed on each side of four sheets S1-S4 (i.e., N=4, M=4, 8 pages), the images are formed on the side A of the first sheet S1, the side A of the second sheet S2, the side B of the first sheet S1, the side A of the third sheet S3, the side B of the second sheet S2, the side A of the fourth sheet S4, the side B of the third sheet S3, and the side B of the fourth sheet S4, in the order described. Thus, the present invention can be also applied to the exemplar process to efficiently eject the remaining sheets in shorter time.

For another example, the image forming unit 10 may be equipped with a function to switch maximum allowable numbers for the numbers N and M of sheets to be continuously printed in a single quick double-face printing cycle. The maximum allowable numbers for the numbers N and M can be changed by, for example, adjusting timings to feed the sheets and a sheet-conveying speed.

In the embodiment of the present invention, the printer 100 ejects the remaining sheets in a process, which is one of the prompt ejection in S152, separate ejection in shorter time in S173-S174, and the page-ordered ejection in S163-S165, according to the print conditions and positions of the remaining sheets and the urgency of ejection. However, the printer 100 may not necessarily select one of the processes but may, for example, eject the sheets according to the prompt-ejecting process in S152, in which the sheet closer to the discharge outlet 77 is ejected earlier, regardless of the print conditions or the urgency of ejection.

In the embodiment of the present invention, the printing operation (i.e., the print job) is aborted upon entry of the cancellation request, however, the print job may not necessarily aborted. For example, the print job may be suspended temporarily to eject sheets and resumed upon entry of a resume request with new sheets.

In the embodiment of the present invention, the ejected succeeding sheet S2 is separated from the preceding sheet S1 by being directed to the different discharge tray 93 from the discharge tray 92 in which the preceding sheet S1 is placed. However, the preceding sheet S1 and the succeeding sheet S2 may be separated by, for example, being directed to different shifted positions from each other within a same discharge tray.

In the embodiment of the present invention, the cancellation request is entered according to the user's key operation. However, the cancellation may not necessarily be triggered by the user. For example, cancellation of the print job may be triggered by an operation error, such as sheet jam, in the printer 100. Further, the urgency of ejecting the remaining sheets may depend on types of errors.

In the embodiment of the present invention, the printer 100 is configured to have the distance between the preceding sheet S1 and the branch point 15 is greater than the distance between the succeeding sheet S2 and the branch point 15. Therefore, the succeeding sheet S2 is ejected prior to the preceding sheet S1 when the cancellation requires prompt ejection. However, if the printer 100 is configured to have the distance between the succeeding sheet S2 and the branch point 15 being greater than the distance between the preceding sheet S1 and the branch point 15, the preceding sheet S1 may be ejected prior to the succeeding sheet S2. For example, if distance between the feed roller 71 and the meeting point 16 is set to be longer, and immediately after the succeeding sheet S2 is picked up by the feed roller, the distance between the succeeding sheet S2 and the branch point 15 may be longer than the distance between the preceding sheet S1 and the branch point 15. Therefore, in such timing, the preceding sheet S1 may be ejected prior to the succeeding sheet S2.

Figure 8:
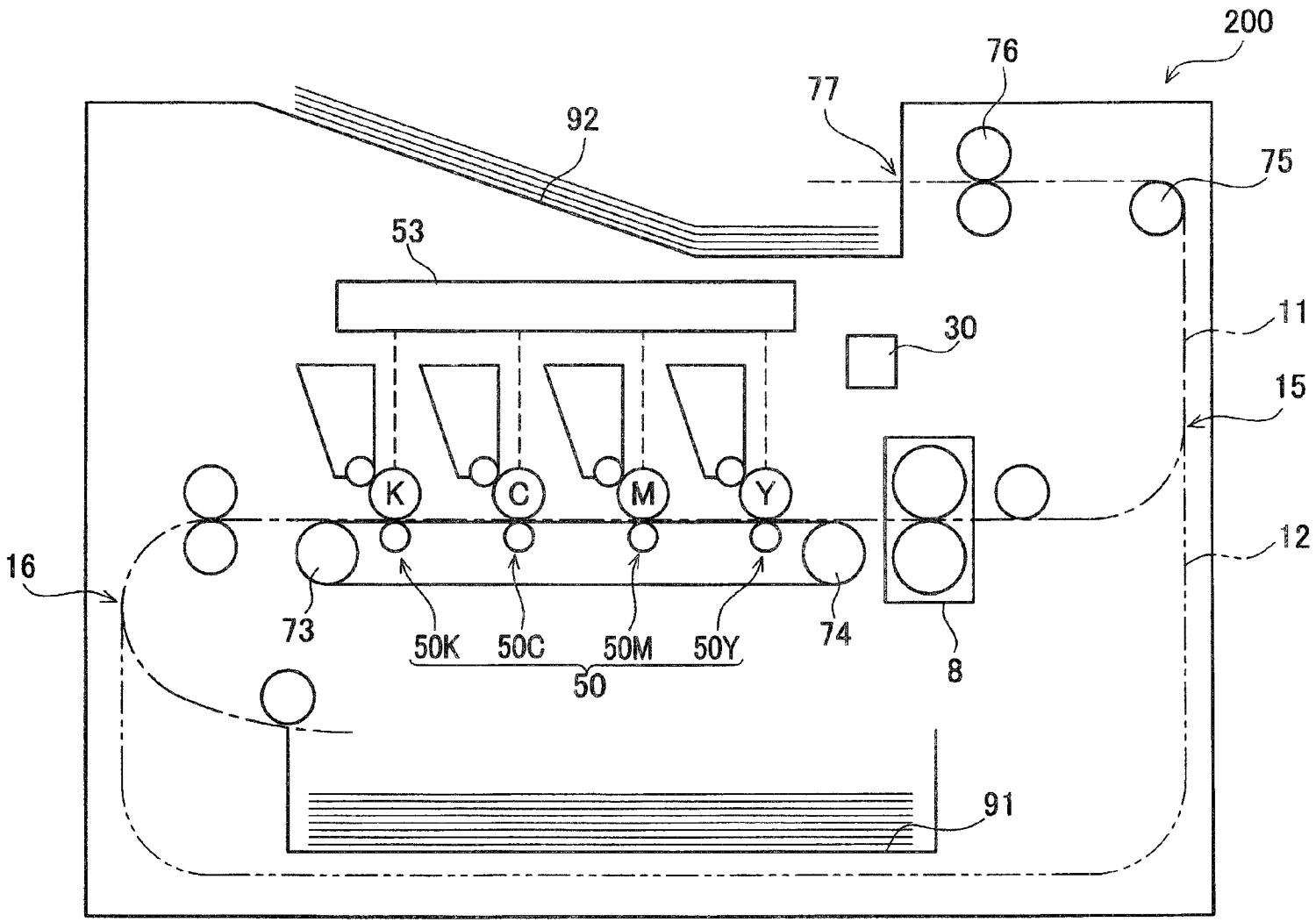
FIG. 8 is a schematic diagram to illustrate an internal configuration of another example of the printer according to the embodiment of the present invention.

In the embodiment of the present invention, the printer 100 is provided with a system to reverse the sheet in the return-feeding path 12 (e.g., the pull-in path 121 and the turning roller 75). However, the sheet may be reversed in a different mechanism. For example, as shown in FIG. 8, the turning roller 75 may be arranged in the regular feeding path 11 in the printer 200, and the sheet may be reversed within the regular feeding path 11.

What is claimed is:

1. An image forming apparatus, which is capable of printing images on two sides of a recording sheet according to a print job, comprising:

an image forming unit to print an image on either side of the recording sheet;

a sheet feeding path, in which the recording sheet is conveyed to have the image printed thereon, the sheet feeding path including a regular feeding path and a return-feeding path and capable of accommodating a plurality of recording sheets;

a sheet-ejection controller to eject the recording sheet out of the sheet feeding path through a sheet outlet;

a second sheet outlet configured for receiving the recording sheet further from the sheet outlet in the direction of the sheet conveyance along the sheet feeding path when cancellation of the print job is entered during the double-face printing operation; and a judging unit to judge as to whether the cancellation request requires urgent ejection of the recording sheets out of the sheet feeding path;

wherein the regular feeding path directs the recording sheet to pass by the image forming unit and to the sheet outlet;

wherein the return-feeding path is branched off from the regular feeding path at a branch point in a lower-stream position with respect to the image forming unit in a direction of sheet-conveyance and merged into the regular feeding path at a meeting point in an upper-stream position with respect to the image forming unit in the direction of sheet-conveyance;

wherein the sheet-ejection controller controls a recording sheet closer to the sheet outlet in the direction of sheet-conveyance along the sheet feeding path to be ejected prior to a recording sheet further from the sheet outlet in the direction of sheet-conveyance along the sheet feeding path when cancellation of the print job is entered during a double-face printing operation, in which the images are formed on one side of N pieces of recording sheets continuously and the other side of M pieces of recording sheets thereafter, whilst M is smaller than or equal to N;

wherein the sheet-ejection controller controls the recording sheet in the sheet feeding path closer to the sheet outlet to be ejected prior to the recording sheet further from the sheet outlet when the judging unit judges that the cancellation request requires urgent ejection; and wherein the sheet-ejection controller ejects the recording sheets in an order of page numbers by conveying a part of the recording sheets through the return-feeding path when the judging unit judges that the cancellation request requires lower urgency in ejecting the recording sheets.

2. The image forming apparatus according to claim 1, wherein the sheet-ejection controller ejects the recording sheets in the sheet feeding path in an order of page numbers by conveying a part of the recording sheets through the return-feeding path when the double-face printing operation requires page-ordered ejection regardless of positional relation of the recording sheets in the sheet feeding path.

3. The image forming apparatus according to claim 1, wherein, when the recording sheets accommodated in the sheet feeding path are assigned to different print jobs including a preceding print job and a succeeding print job, the sheet-ejection controller ejects the recording sheets on basis of the print job by conveying a part of the recording sheets through the return-feeding path.

4. The image forming apparatus according to claim 1, wherein the image forming unit prints the image on the other side of the recording sheet which is remaining in the sheet feeding path at the time of entry of the cancellation request and conveyed through the return-feeding path after the entry of the cancellation request.

5. The image forming apparatus according to claim 4, wherein the image forming unit prints the image on the other side of the recording sheet assigned to the preceding job when the recording sheets accommodated in the sheet feeding path are assigned to different print jobs.

6. The image forming apparatus according to claim 5, wherein the sheet-ejection controller ejects the recording sheet with the image printed on the other side separately from the recording sheets having no image printed on the other side.

7. The image forming apparatus according to claim 1, wherein, when the recording sheets accommodated in the sheet feeding path are assigned to different print jobs including a preceding print job and a succeeding print job, the sheet-ejection controller ejects the recording sheets on basis of the print job by conveying a part of the recording sheets through the return-feeding path.

8. The image forming apparatus according to claim 1, wherein the recording sheet further from the sheet outlet is one of the N pieces of recording sheets with the images formed on one side of the recording sheets for ejection from the second sheet outlet.

9. An image forming apparatus, which is capable of printing images on two sides of a recording sheet according to a print job, comprising:

an image forming unit to print an image on either side of the recording sheet;

a sheet feeding path, in which the recording sheet is conveyed to have the image printed thereon, the sheet feeding path including a regular feeding path and a return-feeding path and capable of accommodating a plurality of recording sheets;

a sheet-ejection controller to eject the recording sheet out of the sheet feeding path through a sheet outlet; and a judging unit configured to judge that a cancellation request requires urgent ejection of the recording sheets out of the sheet feeding path if the cancellation request is input twice or more in a predetermined time period, and to judge that the cancellation request requires lower urgency if the cancellation request is not input twice or more in the predetermined time period;

wherein the regular feeding path directs the recording sheet to pass by the image forming unit and to the sheet outlet;

wherein the return-feeding path is branched off from the regular feeding path at a branch point in a lower-stream position with respect to the image forming unit in a direction of sheet-conveyance and merged into the regular feeding path at a meeting point in an upper-stream position with respect to the image forming unit in the direction of sheet-conveyance;

wherein the sheet-ejection controller controls a recording sheet closer to the sheet outlet in the direction of sheet-conveyance along the sheet feeding path to be ejected prior to a recording sheet further from the sheet outlet in the direction of sheet-conveyance along the sheet feeding path when cancellation of the print job is entered during a double-face printing operation, in which the images are formed on one side of N pieces of recording sheets continuously and the other side of M pieces of recording sheets thereafter, whilst M is smaller than or equal to N:

wherein the sheet-ejection controller controls the recording sheet in the sheet feeding path closer to the sheet outlet to be ejected prior to the recording sheet further from the sheet outlet when the judging unit judges that the cancellation request requires urgent ejection;

wherein the sheet-ejection controller ejects the recording sheets in an order of page numbers by conveying a part of the recording sheets through the return-feeding path when the judging unit judges that the cancellation request requires lower urgency in ejecting the recording sheets.

* * * * *